US011344094B2

(12) United States Patent
Messager

(10) Patent No.: US 11,344,094 B2
(45) Date of Patent: May 31, 2022

(54) REFILL FOR INSERTING INTO A DEVICE FOR TREATING THE HAIR BY PIVOTING

(71) Applicants: L'OREAL, Paris (FR); SEB S.A., Ecully (FR)

(72) Inventor: Edouard Messager, Clichy (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 1001 days.

(21) Appl. No.: 15/541,275

(22) PCT Filed: Dec. 24, 2015

(86) PCT No.: PCT/EP2015/081251
§ 371 (c)(1),
(2) Date: Jun. 30, 2017

(87) PCT Pub. No.: WO2016/107827
PCT Pub. Date: Jul. 7, 2016

(65) Prior Publication Data

US 2017/0354223 A1 Dec. 14, 2017

(30) Foreign Application Priority Data

Dec. 30, 2014 (FR) ..... 1463438

(51) Int. Cl.
*A45D 2/00* (2006.01)
*A45D 1/04* (2006.01)
(Continued)

(52) U.S. Cl.
CPC ..... *A45D 2/002* (2013.01); *A45D 1/04* (2013.01); *A45D 2/40* (2013.01); *A45D 6/00* (2013.01);
(Continued)

(58) Field of Classification Search
CPC ... A45D 1/00; A45D 1/04; A45D 1/06; A45D 1/14; A45D 1/08; A45D 2/001;
(Continued)

(56) References Cited

U.S. PATENT DOCUMENTS 6,848,452 B2 * 2/2005 Kennedy ..... A45D 19/02 132/119.1
2009/0025247 A1 1/2009 Yde et al.
2014/0332026 A1 * 11/2014 Peters ..... A45D 19/0008 132/221

FOREIGN PATENT DOCUMENTS

CA 2310457 A1 * 6/1999 ..... A45D 19/02
EP 1588644 A1 * 10/2005 ..... A45D 33/006
(Continued)

OTHER PUBLICATIONS

Jul. 13, 2018 Japanese Office Action issued in Japanese Patent Application No. 2017-534973.
(Continued)

*Primary Examiner* — Tatiana L Nobrega
*Assistant Examiner* — Sarah Woodhouse
(74) *Attorney, Agent, or Firm* — Oliff PLC

(57) ABSTRACT

The invention relates to a cosmetic refill (20) intended to be inserted in a removable manner into a housing (22) in a device (2) for treating the hair and to the associated treatment device (2). The cosmetic refill (20) comprises a body (23) that has a first wall (40) and a second wall (38) opposite the first wall (40), and at least one coupling relief (50, 52) that extends from each of the first wall (40) and the second wall (38). The coupling relief (50) on the first wall (40) is intended to cooperate with a first surface (46) of the housing (22) when the first wall (40) is introduced into the housing (22). The coupling relief (52) on the second wall (38) is intended to cooperate with a second surface (44) of the
(Continued)

housing (22) when the refill (20) is brought into a use position by pivoting in the housing (22) about a pivot axis (B).

10 Claims, 5 Drawing Sheets

(51) Int. Cl.

| | |
|---|---|
| ***A45D 2/40*** | (2006.01) |
| ***A45D 6/00*** | (2006.01) |
| ***A45D 19/16*** | (2006.01) |
| ***A45D 1/00*** | (2006.01) |
| *A45D 34/00* | (2006.01) |

(52) U.S. Cl.
CPC ..... *A45D 19/16* (2013.01); *A45D 2001/002* (2013.01); *A45D 2001/008* (2013.01); *A45D 2034/005* (2013.01); *A45D 2200/1036* (2013.01)

(58) Field of Classification Search
CPC .... A45D 2/002; A45D 2/40; A45D 2001/002; A45D 2001/008; A45D 6/00; A45D 2006/005; A45D 4/04; A45D 4/10; A45D 19/16; A45D 2034/005; B65D 77/00; B65D 77/06; B65D 83/0055; B65D 21/0204; B65D 21/0233; B65D 21/02
USPC ..... 132/269, 108, 109, 110, 112, 116, 221, 132/224, 227, 228, 229, 231, 232, 272, 132/290; 222/105, 325
See application file for complete search history.

(56) References Cited

FOREIGN PATENT DOCUMENTS

| | | | | | |
|---|---|---|---|---|---|
| JP | S57-197674 | U | | 12/1982 | |
| JP | 5186564 | B2 | | 4/2013 | |
| WO | 2009/015027 | A2 | | 1/2009 | |
| WO | 2009/078046 | A1 | | 6/2009 | |
| WO | 2009/148106 | A1 | | 12/2009 | |
| WO | WO-2009148106 | A1 | * | 12/2009 | ..... A45D 24/24 |
| WO | 2013/090896 | A1 | | 6/2013 | |
| WO | WO-2016079407 | A1 | * | 5/2016 | ..... A45D 1/14 |

OTHER PUBLICATIONS

Mar. 16, 2016 International Search Report issued in International Patent Application No. PCT/EP2015/081251.
Jul. 3, 2019 Office Action issued in European Patent Application No. 15 817 396.3.

* cited by examiner

REFILL FOR INSERTING INTO A DEVICE FOR TREATING THE HAIR BY PIVOTING

The present invention relates to a cosmetic refill intended to be inserted in a removable manner into a housing in a device for treating the hair and to devices for treating the hair that comprise such a refill, and more particularly, but not exclusively, those intended for shaping the hair, in particular for straightening, curling or crimping the hair, comprising a refill of cosmetic product.

BACKGROUND

Usually, hair straighteners consist of two arms that are connected together with the aid of a hinge which makes it possible to open and close said arms, and of at least one heating element disposed on the arms. During operations of styling a lock of hair, said lock is introduced between the two arms in the open position and then the two arms are closed manually over the lock of hair. The lock of hair is then subjected to the heat output by the heating element, until the two arms are opened and the lock of hair is removed.

Application WO 2009/078046 describes a hairstyling appliance comprising two arms that are connected together so as to allow the appliance to be opened and closed, at least one heating member and at least one seat for accommodating a hair treatment device, the hair treatment device allowing a haircare product to be dispensed during operation. The hair treatment device is composed of a support material impregnated with a haircare product and suitable for a single use.

WO 2009/015027 and US 2009/0025247 disclose a hair straightening device that makes it possible to apply a haircare product by contact with the hair. The haircare product to be applied is contained in a removable refill for its application. The removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding.

There is a need to further improve devices for applying a haircare product such that the user can easily refill the device with haircare product and/or change the haircare product to be applied.

SUMMARY

According to a first of its aspects, a subject of the invention is a cosmetic refill intended to be inserted in a removable manner into a housing in a device for treating the hair, comprising:

- a body that has a first wall and a second wall opposite the first wall,
- at least one coupling relief that extends from each of the first wall and the second wall,
  - (i) the coupling relief on the first wall being intended to cooperate with a first surface of the housing when, in particular in a first step, the first wall is introduced into the housing, the refill then being able to be inclined relative to the housing, and
  - (ii) the coupling relief on the second wall being intended to cooperate with a second surface of the housing when, in particular in a second step, the refill is brought into a use position, preferably by pivoting in the housing about a pivot axis.

Such a refill is easy to introduce into the housing in the device for treating the hair simply by pivoting the refill in the housing.

In addition, it is possible, if desired, when the refill is fitted in the device in such a way, to produce the refill such that it maintains a surface, of non-negligible extent, turned towards the outside and visible to the user. This surface can serve as a holder for information intended for the user, relating for example to the type of composition contained in the refill, and/or acting as a reminder for the user of the refill manufacturer's mark.

Finally, the user can easily see that the refill is present.

Moreover, the manner in which the refill is fixed proves to be robust and relatively insensitive to soiling; in addition, the housing can remain relatively easy to access when a refill is absent, thereby making it easier to clean. This is advantageous in particular when the device is used intensively, this being the case in a hair salon in particular.

The coupling reliefs keep the refill in position in the housing, in particular by snap-fastening. This snap-fastening is advantageously accompanied by an audible and/or haptic click, which reassures the user that the refill has been fitted effectively on the device.

Preferably, the refill has an elongate shape along a longitudinal axis X.

Preferably, the body of the refill defines a cavity for receiving an applicator member for a haircare product. The cavity may open towards the outside by way of an opening with an axis substantially parallel to the pivot axis. Such an orientation is preferred since it makes it possible to orient an unlocking tongue for the refill laterally with respect to the cavity, thereby reducing the risk of accidental actuation of or damage to this tongue during use; the risk of hair getting caught on the tongue is also reduced.

The refill advantageously comprises the applicator member for the haircare product, inserted into the cavity.

The body preferably has an approximately parallelepipedal shape.

The body preferably has a length of between 70 and 100 mm.

The height of the body, measured between the opening and the wall of the refill opposite the opening, is preferably between 10 and 30 mm. The height of the refill, including the applicator member, is preferably greater than the height of the body on its own.

The width of the body, measured perpendicularly to the length and the height of the body, is preferably between 5 and 20 mm. The width of the refill is preferably greater than or equal to the width of the body. This may be on account of the shape of the coupling reliefs.

Preferably, apart from the applicator member, the refill is in one piece, in particular moulded in one piece by injection-moulding thermoplastic material. In other words, the body and the coupling reliefs on the first and second walls are in one piece, in particular moulded in one piece by injection-moulding thermoplastic material.

Preferably, the first wall and the second wall define planar surfaces perpendicular to the longitudinal axis of the refill and can form the front and rear ends of the refill.

The first and/or the second wall may each have at least two coupling reliefs. The distance between the coupling reliefs on one and the same wall, measured between the centres of mass of said reliefs, may be between 1 and 10 mm.

The coupling relief(s) on the first wall may each be a protruding relief intended to be inserted into a recessed relief in the first surface of the housing. The or each coupling relief on the first wall may be elongate in a direction parallel to the opening axis of the housing. The coupling relief(s) on the first wall may be asymmetric with respect to a median transverse plane therefor. In particular, the coupling relief(s) on the first wall may, in side view, have a substantially triangular shape, in particular the shape of a right-angled triangle, the right angle being one of the angles formed with the first wall, in particular the angle closest to the outside when the refill is in its use position in the device for treating the hair. Producing the relief(s) in the form of teeth having a slope on the side on which the refill is introduced into the housing makes the insertion of the refill into the housing smoother.

In a variant, the coupling relief(s) on the first wall are each a recessed relief intended to receive a protruding relief on the first surface of the housing.

The coupling relief on the second wall is preferably an elastically deformable coupling tongue that has, on its surface facing the second surface, at least one protruding relief to be inserted into a recessed relief in the second surface, or at least one recessed relief for receiving a protruding relief on the second surface. The recessed relief may be a simple indentation, defined for example by a shouldered wall, or a housing with a closed contour, for example a through-opening in a wall.

The coupling tongue may comprise at least two protruding reliefs or at least two recessed reliefs.

The coupling tongue may have a width substantially equal to the height of the body. The coupling tongue preferably has a length greater than the width of the body.

The coupling tongue can be attached to the second wall by a rounded portion about an axis parallel to the pivot axis. This rounded portion can form a groove at its meeting point with the body. The rounded portion makes it easier for the tongue to bend while reducing the risk of fatigue of the plastics material.

The coupling tongue extends along a longitudinal axis perpendicular to the longitudinal axis of the refill and to the pivot axis.

Preferably, the coupling tongue extends parallel to the second wall.

The body may extend between an abscissa $z_1$ and an abscissa $z_2$ along the longitudinal axis of the tongue. The coupling tongue may extend between the abscissa $z_1$ and an abscissa $z_3$ along this axis. The distance $|z_3-z_1|$ is preferably greater than the distance $|z_2-z_1|$. The coupling tongue may jut out from one side of the body along this axis by a distance $|z_3-z_2|$ greater than or equal to 1 mm.

The coupling tongue may have at least one gripping relief, in particular protruding ribs, disposed between the abscissas $z_2$ and $z_3$.

The protruding relief(s) on or the recessed relief(s) in the coupling tongue may extend between the abscissas $z_1$ and $z_2$.

A further subject of the invention is a device for treating the hair, comprising:

- two arms that are able to move relative to one another between a moved-together configuration for treating the hair and a spaced-apart configuration for inserting hair to be treated between said arms, one of the arms comprising a housing,
- a refill as defined above, which is disposed in a removable manner in the housing.

The housing may be open towards the other of the arms and laterally towards the outside of the device.

Preferably, the device comprises an applicator member inserted into the cavity in the refill. The refill is inserted into the housing laterally, the opening of the cavity being oriented towards the other of the arms and the relief on the second wall being oriented towards the outside of the device.

Compared with fitting on the top of the arm, fitting the refill on the side of the arm makes it possible to position the refill as close to the other arm as necessary when the two arms are moved together, regardless of the height of the refill. The latter can thus be produced with just the height that is necessary for obtaining the desired capacity, and it is possible to keep the consumption of plastics material for manufacturing the refill at a minimum. Moreover, during use, the pressing of the refill against the hair causes a reaction force on the refill, and this can result in detachment of the refill. By insertion into the housing laterally, this reaction force is perpendicular to the direction of insertion of the cartridge, thereby limiting the risks of the latter detaching during the application of the product.

The housing may comprise reliefs complementary to the coupling reliefs, in particular protruding reliefs or recessed reliefs, disposed on the facing surfaces of the first and the second wall of the body of the refill. Said complementary reliefs keep the refill in the housing.

Preferably, the coupling tongue juts out laterally from the device such that it is accessible to the user.

The arm opposite the one on which the refill is disposed may have a steam outlet, and preferably also a comb.

Preferably, in particular when the hair is intended to be straightened, the device comprises a heating element intended to come into contact with the hair, and better still two heating elements, each disposed on an arm, preferably facing one another when the arms are in the moved-together configuration. This or these heating element(s) may each comprise a plate, made of a material that is a good conductor of heat, that defines a hot surface for bringing into contact with the hair, the temperature of said surface being for example greater than or equal to 95° C., better still between 90 and 230° C.

Preferably, the device for treating the hair according to the invention is a straightener having flat heating elements, in particular which come into contact in the closed position.

A further subject of the invention is a refill intended to be inserted in a removable manner into a housing in a device for treating the hair, comprising a first wall and a second wall opposite the first wall, the first wall having at least one coupling relief and the second wall having an elastically deformable coupling tongue.

The features described above relating to the refill also apply here.

A further subject of the invention is a device for treating the hair, comprising:

- two arms that are able to move relative to one another between a moved-together configuration for treating the hair and a spaced-apart configuration for inserting hair to be treated between said arms, one of the arms comprising a housing,
- a refill disposed in a removable manner in the housing, comprising at least a first wall and a second wall opposite the first wall, the first wall facing a first surface of the housing and the second wall facing a second surface of the housing,
  - (i) the first wall or the first surface having a first protruding relief that is snap-fastened into a first corresponding recessed relief in the other of the first wall and the first surface, and
  - (ii) one of the second wall and the second surface having a second protruding relief that is snap-fastened in a removable manner into a second recessed relief in the other of the second wall and the second surface.

Preferably, the second protruding relief is an elastically deformable tongue as described above.

The or each first protruding relief may be elongate in a direction parallel to that of the width of the refill. The coupling relief(s) on the first wall may be asymmetric with respect to a median transverse plane therefor. In particular, the first protruding relief(s) may, in side view, have a substantially triangular shape, in particular the shape of a right-angled triangle, the right angle being one of the angles formed with the first wall, in particular the angle closest to the outside when the refill is in its use position in the device for treating the hair.

The invention also relates to a method for introducing a refill according to the invention into a device for treating the hair that comprises a housing for receiving the refill, comprising the steps of:

introducing the first surface into the housing while keeping the refill inclined relative to the housing in order to make the coupling relief on the first wall cooperate with the corresponding relief on the first surface of the housing, pivoting the refill about its pivot axis in the housing in order to bring it into its use position and to make the coupling relief on the second wall cooperate with the second surface of the housing.

The invention may be better understood from reading the following detailed description of non-limiting illustrative embodiments thereof and from examining the appended drawing, in which:

In the rest of the description, identical or similar elements or elements having identical or similar functions bear the same reference signs in the figures, unless stated otherwise.

FIGS. 1 and 2 show the handpiece 2 of an example of a device for treating the hair according to the invention.

Figure 1:
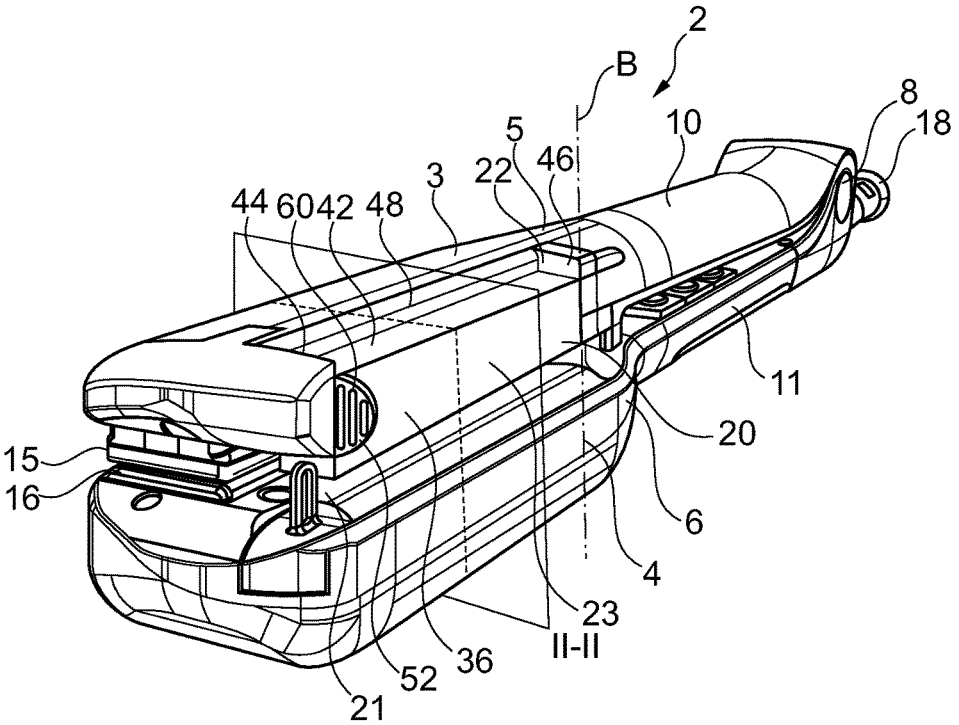
FIG. 1 shows a schematic perspective view of one example of a device.
Figure 2:
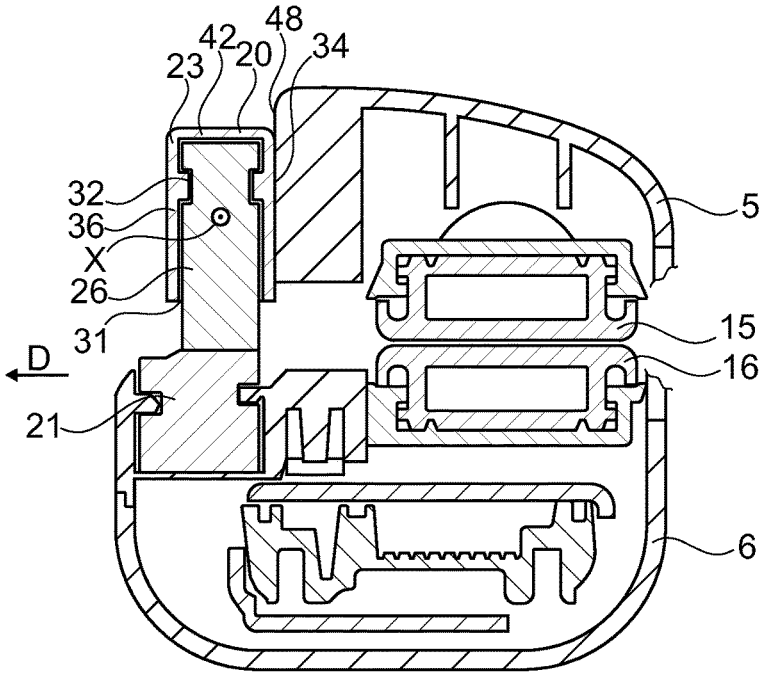
FIG. 2 is a cross-sectional view on II-II in FIG. 1.
Figure 3:
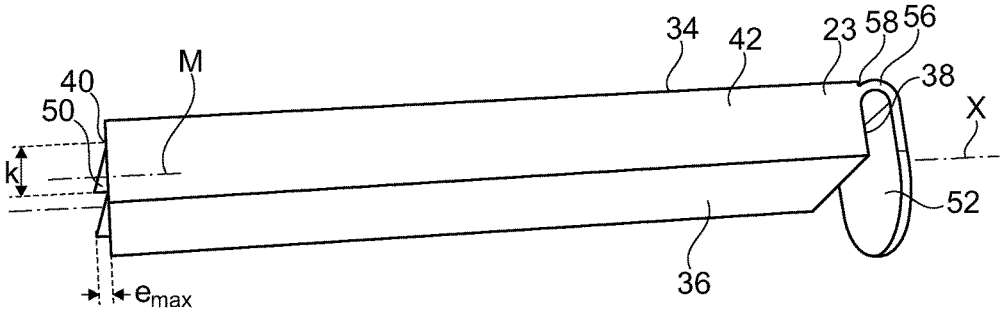
FIGS. 3 to 5 are schematic perspective views of an example of a refill.

This handpiece 2 has two jaws 3 and 4 that are able to move with respect to one another between a spaced-apart configuration (not shown) for introduction between said jaws of a lock of hair, and a moved-together configuration for treatment.

The jaws 3 and 4 are carried by an upper arm 5 and a lower arm 6, respectively, which, in the example in question, are connected together at one end by an articulation 8, the handpiece 2 thus forming tongs.

The upper arm 5 and lower arm 6 each preferably have a total length of between 22 cm and 31 cm and define, between the articulation 8 and the jaws 3 and 4, respective half-handles 10 and 11 on which the user can press in order to move the jaws 3 and 4 together.

An elastic return member (not visible) is preferably provided to return the jaws 3 and 4 to a spaced-apart configuration, this elastic return member being for example a spring disposed around an articulation pin 8.

The invention is not limited to a particular manner of connecting the upper arm 5 and lower arm 6 together and the jaws 3 and 4 may be rendered able to move in some other way without departing from the scope of the present invention. However, the presence of an articulation is largely preferred for the ergonomics it provides.

The jaws 3 and 4 define between one another a region for treating the hair, said region being intended to receive a lock of hair to be treated, the handpiece 2 being moved along said lock during the treatment, for example in the direction from the root to the end of the hair.

In the example in question, the handpiece 2 is configured to apply a cosmetic product, to treat the hair by way of steam and to carry out a heat treatment of the hair by contact with two hot surfaces 15 and 16.

In a variant, the handpiece 2 is configured to apply a cosmetic product, and then to comb the hair, to treat the hair by way of steam and to carry out a heat treatment of the hair by contact with two hot surfaces 15 and 16.

Figure 4:
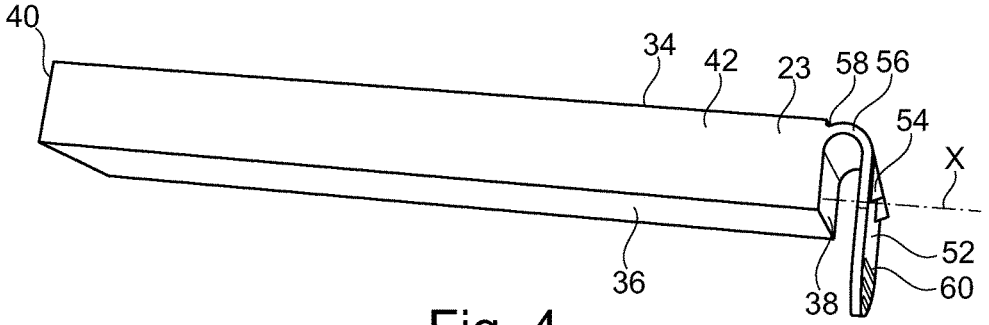

The direction D of movement of the handpiece 2 over the hair, illustrated in FIG. 4, is preferably substantially perpendicular to the upper arm 5 and lower arm 6.

The handpiece 2 is connected by a line, in the example in question, to a base station (not shown) that is fixed during the treatment and is connected to the mains.

This base station provides the electric power supply to the handpiece 2 and also its supply with water in order to generate steam, and may also carry out additional functions of processing electrical signals received from the handpiece 2. The line 18 which connects the handpiece 2 to the base station can thus comprise various electrical conductors and a water supply pipe.

A user interface (not shown in the figures) can be present on the handpiece 2 so as to allow the user for example to start up certain components thereof, or not.

The cosmetic product is applied by a refill 20 carried in a housing 22 in one of the two arms, 5 or 6, in this case the upper arm 5.

The housing 22 in the refill 20 is delimited by a front surface 44 and a rear surface 46 that are connected together by a lateral surface 48. The housing 22 is open at least towards the other arm 6 and towards the outside.

The refill is illustrated in more detail in FIGS. 3 to 7.

The refill 20 comprises a body 23 and coupling reliefs 25 for fixing the refill 20 in its housing 22.

The body 23 has a cavity 30 that opens towards the outside by way of an opening 31 into which an applicator member 26 is inserted while the refill is being manufactured. The cavity 30 is oriented towards the other arm 6 when the refill 20 is in the use position, such that the applicator member 26 can come into contact with the hair extending through the treatment region over a pressing element 21. The pressing element 21 may be removable with respect to the arm that carries it.

The body 23 furthermore comprises protruding reliefs 32 for retaining the applicator member 26 in the cavity 30, extending into the latter.

Figure 5:
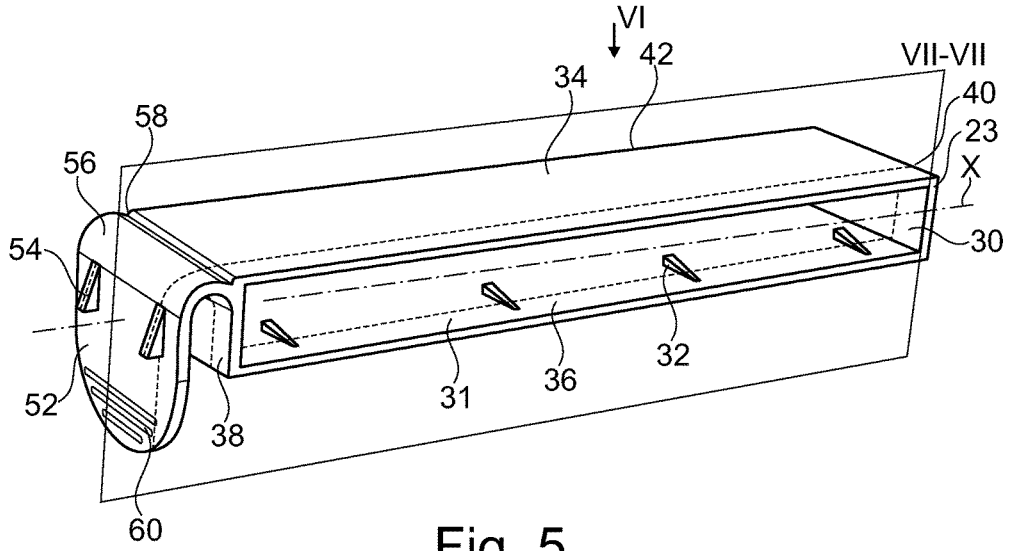

The body 23 has substantially the overall shape of a rectangular parallelepiped and is elongate along a longitudinal axis X. In cross section, the body 23 is U-shaped, as illustrated in FIG. 5.

The body 23 comprises a front wall 38 and a rear wall 40 that are opposite one another and are connected by two side walls 34 and 36 and by a bottom 42.

The body 23 has a length L, measured between the front wall 38 and the rear wall 40, of between 70 and 100 mm, a height H, measured from the opening 30 to the bottom 42, of between 10 and 30 mm, and a width l, measured perpendicularly to the length L and to the height H, of between 5 and 20 mm.

The rear wall 40 comprises at least one coupling relief 50, in this case two coupling reliefs 50. In FIGS. 3 to 7, the coupling reliefs 50 on the rear wall 40 are protruding reliefs having an asymmetric shape relative to their median axis M. Said protruding reliefs have a substantially triangular shape in side view.

The coupling reliefs 50 are centred on the rear wall 40 and have a maximum thickness $e_{max}$, measured from the rear wall 40 along the axis X, of between 0.2 and 5 mm, in this case substantially equal to 1 mm, and a length k of between 4 and 10 mm.

Figure 6:
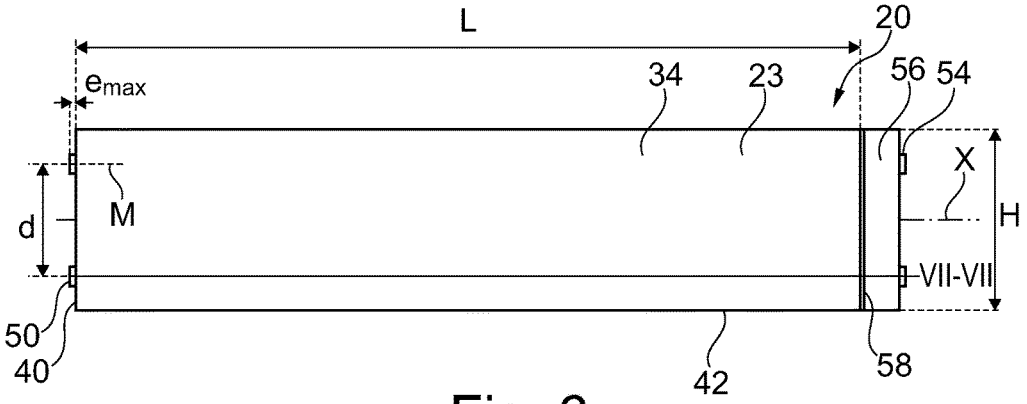
FIG. 6 is a top view along VI in FIG. 5.

As illustrated in FIG. 6, the coupling reliefs 50 are spaced apart by a distance d of between 1 and 10 mm.

The front wall 38 comprises at least one coupling relief. Here, this coupling relief is an elastically deformable coupling tongue 52 having at least one protruding relief 54, in this case two protruding reliefs 54, and gripping reliefs 60.

Figure 7:
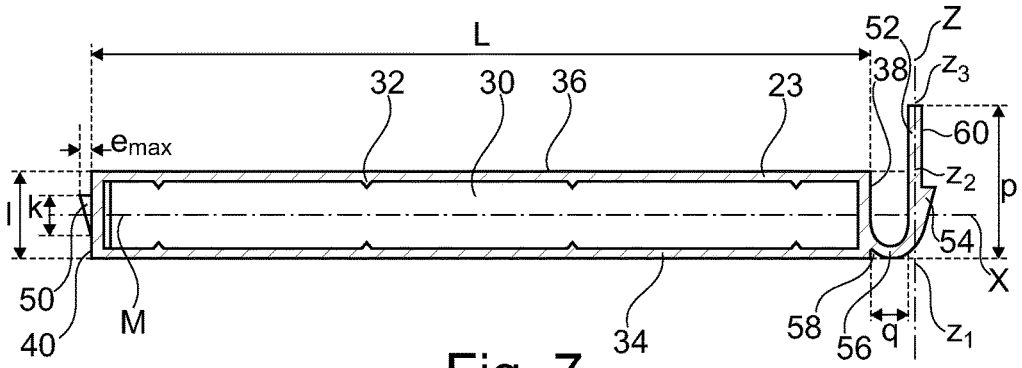
FIG. 7 is a cross-sectional view on VII-VII in FIGS. 5 and 6.

The coupling tongue 52 is connected to the front wall 38 by way of a rounded portion 56 forming a groove 58 therewith. The coupling tongue 52 extends parallel to the front wall 38 and is spaced apart from the latter by a distance q, measured between the front wall 38 and the rear of the coupling tongue 52, of between 1 and 5 mm, as illustrated in FIG. 7.

The coupling tongue 52 extends along a longitudinal axis Z along a length p greater than the width l of the body 23. The coupling tongue 52 extends between the abscissas $z_1$ to $z_3$ along the axis Z and the body 23 extends between the abscissas $z_1$ and $z_2$ along the axis Z. The coupling tongue 52 and the body 23 thus extend from the same abscissa $z_1$.

The protruding reliefs 54 extend from the wall of the coupling tongue 52 oriented towards the outside and have a shape substantially identical to that of the coupling reliefs 50 on the rear wall 40. The protruding reliefs 54 extend between the abscissas $z_1$ and $z_2$ of the body 23 along the axis Z.

The gripping reliefs 60 extend from the wall of the coupling tongue oriented towards the outside between the abscissas $z_2$ and $z_3$ along the axis Z.

In order to install the refill, the user introduces the rear wall 40 of the refill 20 into the housing 22, through the open lateral part of the housing, facing the rear surface 46 of the latter. The coupling reliefs 50 come to face complementary recessed reliefs (not shown) in the rear surface 46. The user then pivots the refill 20 about a pivot axis B, shown in FIG. 1, in order to put it into the use position in the housing 22. The coupling reliefs 50 are then housed in the complementary recessed reliefs in the rear surface 46 and the protruding reliefs 54 on the coupling tongue 52 are snap-fastened into complementary recessed reliefs (not shown) in the front surface 44 by elastic deformation of the coupling tongue 52. The coupling reliefs 50 and the protruding reliefs 54 keep the refill 20 in position in the housing 22.

In order to remove the refill 20, the user has to press in the direction of the rear of the refill 20, on the end part of the coupling tongue 52 that juts out from the housing 20, while pivoting the refill about its pivot axis B. Pressing on the coupling tongue 52 makes it possible to curve the latter and thus disengage the protruding reliefs 54 from the complementary recessed reliefs in the front surface 44. Pivoting the refill 20 makes it possible to take the front part of the refill 20 out of its housing 22 and to disengage the coupling reliefs 50 on the rear wall 40. Once the refill 20 has been pivoted, the user then only has to take the latter out of its housing 22.

The examples in FIGS. 8 to 13 differ from the one in FIGS. 1 to 7 by way of the shape of the coupling reliefs on the front wall 38 and on the rear wall 40.

Figure 8:
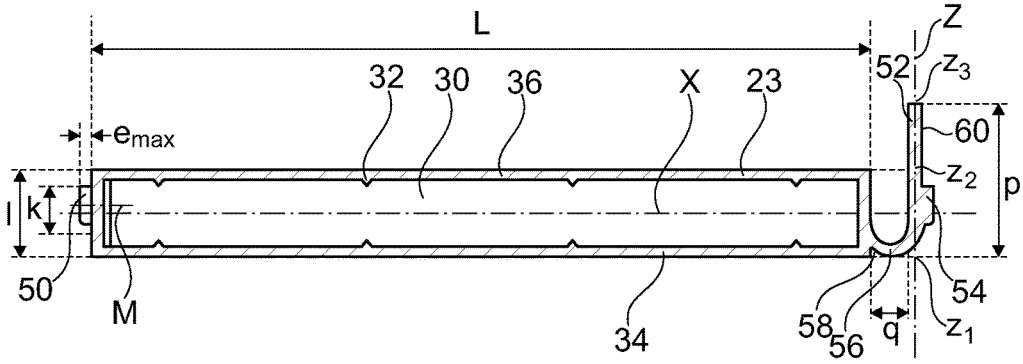
FIGS. 8 to 11 show examples of refills in cross section.

In the example illustrated in FIG. 8, the protruding reliefs 54 on the coupling tongue 52 and the coupling reliefs 50 on the rear wall 40 have a non-triangular profile in side view, in particular having a substantially rectangular shape with a rounded edge. In a variant, the protruding reliefs 54 on the coupling tongue 52 and the coupling reliefs 50 on the rear wall 40 can have any other shape in side view, in particular a polygonal shape, or having a convex wall towards the outside.

Figure 9:
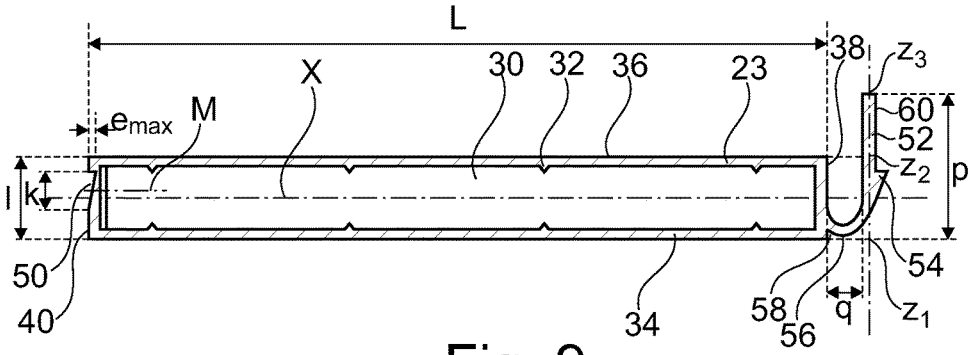

In the example in FIG. 9, the coupling reliefs 50 on the rear wall 40 are recessed reliefs intended to receive complementary protruding reliefs on the rear surface 46.

Figure 10:
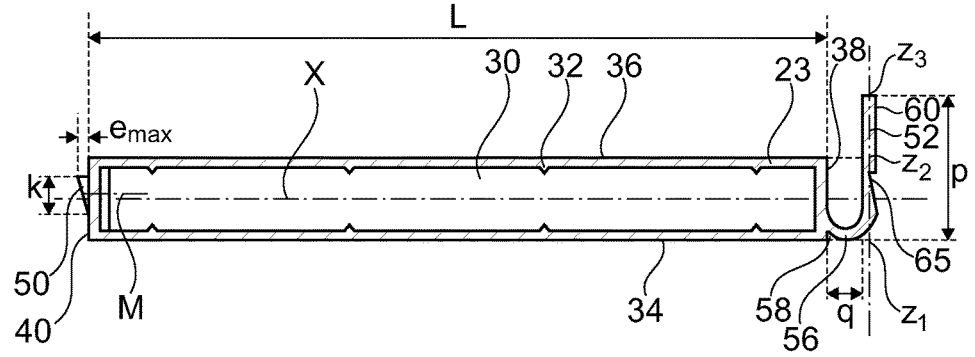

In the example in FIG. 10, the coupling tongue 52 does not have a protruding relief but has, on its outer surface, recessed reliefs 65 intended to receive complementary protruding reliefs on the front surface 44.

Figure 11:
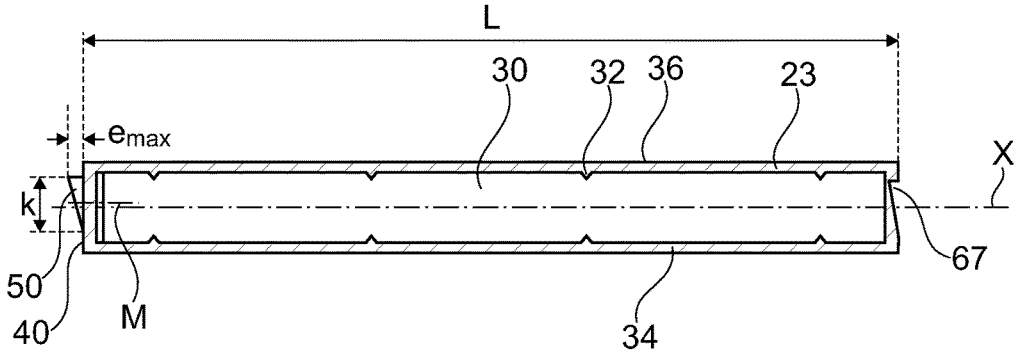

In the example in FIG. 11, the front wall 44 comprises a recessed coupling relief 67 intended to receive a protruding relief on the front surface 44, in particular a protruding relief carried by an elastically deformable tongue on the front surface 44. Thus, in order to remove the refill 20, the user can act on the tongue on the front surface 44 of the housing 22 in order to disengage the protruding reliefs on the front surface 44 from the recessed reliefs in the front wall 38 and thus to free the refill 20 from the housing 22.

Figure 12:
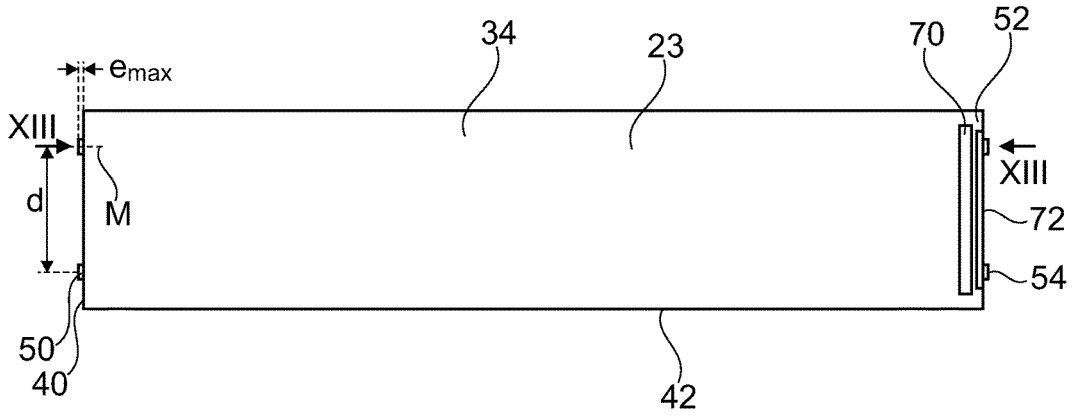
FIG. 12 is a schematic side view of an example of a refill.
Figure 13:
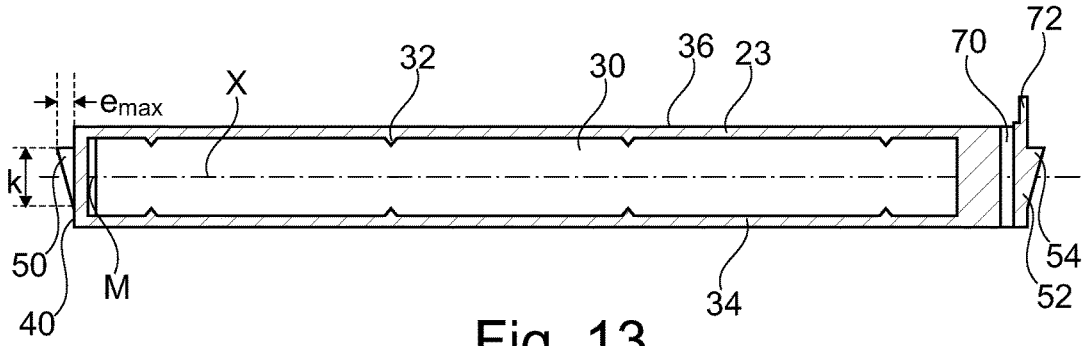
FIG. 13 is a cross section on XIII-XIII in FIG. 11.

In the example illustrated in FIGS. 12 and 13, the front wall 38 comprises an elastically deformable extension 52. This extension 52 is separated from the wall 38 by an opening 70. The extension 52 comprises a protruding relief 54 intended to engage in a recessed relief in the front surface 44 and a gripping tongue 72 for manually deforming the extension and, in this way, to free the protruding relief 54 from the complementary recessed relief.

The invention is not limited to the exemplary embodiments which have just been described, the characteristics of which may be combined with one another as parts of variants which are not illustrated.

For example, the protruding reliefs on the coupling tongue and the coupling reliefs on the rear wall can have different shapes.

The coupling tongue can be present on the front surface 44 of the housing 22, rather than being directly on the refill.

The expression "comprising a" should be understood as being synonymous with "comprising at least one".

The invention claimed is:

1. A cosmetic refill intended to be inserted in a removable manner into a housing in a device for treating the hair, comprising:

a body that has a first wall and a second wall opposite the first wall and that defines between them a cavity, the cavity opening toward the outside at least by way of an opening of the body, an applicator member for applying a cosmetic product to the hair inserted in the cavity that extends at least partially through the opening of the body, (i) a coupling relief on the first wall being intended to cooperate with a first surface of the housing when the first wall is introduced into the housing, and (ii) an elastically deformable coupling tongue connected at a first end thereof to the second wall by way of a rounded portion, the coupling tongue having an inner surface spaced from and facing the second wall, an outer surface opposite the inner surface and a second end opposite the first end, wherein the coupling tongue is configured to cooperate with a second surface of the housing when the cosmetic refill is brought into a use position in the device for treating the hair by pivoting the cosmetic refill in the housing about a pivot axis, the opening of the cavity extends along a plane that is perpendicular to the pivot axis, at least one protruding relief on the outer surface between the first and second ends configured to be inserted into a recessed relief in the second surface of the housing, or at least one recessed relief on the outer surface between the first and second ends for receiving a protruding relief on the second surface of the housing, wherein the coupling tongue extends along a longitudinal axis perpendicular to a longitudinal axis of the refill and perpendicular to the pivot axis, the second wall having first and second ends defining a width therebetween, the width measured in a direction parallel to the coupling tongue, such that a first axis extending from the first end and intersecting the longitudinal axis of the coupling tongue defines a first abscissa at the intersection thereof, and a second axis extending from the second end and intersecting the longitudinal axis of the coupling tongue defines a second abscissa at the intersection thereof, and wherein the protruding relief or the recessed relief on the coupling tongue is positioned between the first and second abscissas, a third abscissa positioned at the second end along the longitudinal axis of the coupling tongue, the distance between the third and the first abscissas being greater than the distance between the second and the first abscissas, a distance between the third and the second abscissas being greater than or equal to 1 mm, the coupling tongue extending substantially parallel to the second wall, wherein the space between the inner surface and the second wall is between 1 and 5 mm, wherein the coupling tongue has at least one gripping relief disposed between the third and second abscissas.

2. Refill according to claim 1, which, apart from the applicator member, is in one piece.

3. Refill according to claim 1, which has an elongate shape along a longitudinal axis.

4. Refill according to claim 3, wherein the first wall and the second wall define planar surfaces perpendicular to the longitudinal axis.

5. Refill according to claim 1, wherein the coupling relief on the first wall is:

a protruding relief intended to be inserted into a recessed relief in the first surface of the housing; or a recessed relief intended to receive a protruding relief on the first surface of the housing.

6. Refill according to claim 1, wherein the first wall comprises at least two coupling reliefs.

7. A hair treating device, comprising:

two arms that are able to move relative to one another between a moved-together configuration for treating the hair and a spaced-apart configuration for inserting hair to be treated between said arms, one of the arms comprising a housing, a cosmetic refill disposed in a removable manner in the housing comprising:

a body that has a first wall and a second wall opposite the first wall and that defines between them a cavity, the cavity opening toward the outside at least by way of an opening of the body, an applicator member for applying a cosmetic product to the hair inserted in the cavity that extends at least partially through the opening of the body, (i) a coupling relief on the first wall being intended to cooperate with a first surface of the housing when the first wall is introduced into the housing, and (ii) an elastically deformable coupling tongue connected at a first end thereof to the second wall by way of a rounded portion, the coupling tongue having an inner surface spaced from and facing the second wall, an outer surface opposite the inner surface and a second end opposite the first end, wherein the coupling tongue is configured to cooperate with a second surface of the housing when the cosmetic refill is brought into a use position in the hair treating device by pivoting the cosmetic refill in the housing about a pivot axis, the opening of the cavity extends along a plane that is perpendicular to the pivot axis, at least one protruding relief on the outer surface between the first and second ends configured to be inserted into a recessed relief in the second surface of the housing, or at least one recessed relief on the outer surface between the first and second ends for receiving a protruding relief on the second surface of the housing, wherein the coupling tongue extends along a longitudinal axis perpendicular to a longitudinal axis of the refill and perpendicular to the pivot axis, the second wall having first and second ends defining a width therebetween, the width measured in a direction parallel to the coupling tongue, such that a first axis extending from the first end and intersecting the longitudinal axis of the coupling tongue defines a first abscissa at the intersection thereof, and a second axis extending from the second end and intersecting the longitudinal axis of the coupling tongue defines a second abscissa at the intersection thereof, and wherein the protruding relief or the recessed relief on the coupling tongue is positioned between the first and second abscissas, and a third abscissa positioned at the second end along the longitudinal axis of the coupling tongue, the distance between the third and the first abscissas being greater than the distance between the second and the first abscissas, a distance between the third and the second abscissas being greater than or equal to 1 mm, the coupling tongue extending substantially parallel to the second wall, wherein the space between the inner surface and the second wall is between 1 and 5 mm, wherein the coupling tongue has at least one griping relief disposed between the third and second abscissas.

8. The hair treating device according to claim 7, wherein the housing is open towards the other of the arms and laterally towards the outside of the device.

9. The hair treating device according to claim 7, which comprises at least one heating element intended to come into contact with the hair.

10. Method for introducing a refill into a hair treating device that comprises a housing for receiving the refill, comprising the steps of:

providing the cosmetic refill according to claim 1, introducing the first wall into the housing while keeping the refill inclined relative to the housing in order to make the coupling relief on the first wall cooperate with the corresponding relief on the first surface of the housing, pivoting the refill in the housing in order to bring it into its use position and to make the coupling relief on the second wall cooperate with the second surface of the housing.

* * * * *